US005257417A

United States Patent [19]

Oleson

[11] Patent Number: 5,257,417

[45] Date of Patent: Nov. 2, 1993

[54] FIRE FIGHTER'S FACE SHIELD ASSEMBLY

[75] Inventor: Richard A. Oleson, Lexington, Ky.

[73] Assignee: E. D. Bullard Company, Sausalito, Calif.

[21] Appl. No.: 930,277

[22] Filed: Aug. 17, 1992

[51] Int. Cl.[5] ..... A42B 3/04

[52] U.S. Cl. ..... 2/5; 2/8; 2/9

[58] Field of Search ..... 2/5, 7, 8, 9, 173, 185 R, 2/424, 423

[56] References Cited

U.S. PATENT DOCUMENTS

| | | | |
|---|---|---|---|
| 586,039 | 7/1897 | Hopkins et al. | 2/5 |
| 2,421,427 | 6/1947 | Mamlin et al. | 2/5 |
| 3,535,706 | 10/1970 | Aileo | 2/5 |
| 5,110,655 | 5/1992 | Engler et al. | 2/7 |
| 5,153,055 | 10/1992 | Ko | 2/8 |
| 5,157,788 | 10/1992 | Schultz | 2/7 |

FOREIGN PATENT DOCUMENTS

| | | | |
|---|---|---|---|
| 681314 | 10/1952 | United Kingdom | 2/5 |

*Primary Examiner*—Clifford D. Crowder
*Assistant Examiner*—Amy B. Vanatta
*Attorney, Agent, or Firm*—Maurice L. Miller, Jr.

[57] ABSTRACT

A transparent plastic face shield assembly for a fire fighter's helmet is disclosed which employs a thermally reflective appliqué on each of the end sections of a face shield near its points of pivotal attachment to opposite sides of the helmet. The appliqués essentially cover the outer facing surfaces of the face shield end sections and contain a channel along lower edges thereof in which lower edge portions of the end sections are disposed in close fitting relation to prevent lower edges of the end sections from deforming when exposed to high temperature conditions. The appliqués should be constructed of highly heat reflective aluminum alloy such as aluminum foil or sheet. The appliqués are attached to the face shield end sections by a high temperature resistant adhesive.

11 Claims, 2 Drawing Sheets

FIRE FIGHTER'S FACE SHIELD ASSEMBLY

BACKGROUND OF THE INVENTION

This invention relates generally to plastic face shields which are pivotally mounted on various types of hard hats, such as fire fighters helmets, and which are worn in high temperature environments such as often encountered in burning buildings and the like. More specifically, the invention relates to means for preventing plastic material located in end sections of the shield near the pivotal attachment points from deforming and sagging below the hat brim when the shield is in a raised storage position and when exposed to high temperatures so as to prevent contact of the hot, sagging plastic with the wearer's face, neck and/or shoulders and thus prevent serious burns.

Fire helmets which have transparent plastic face shields pivotally attached thereto have long been known and used in the prior art. Typically, such prior art face shields are constructed of high temperature plastics such as polycarbonates, polysulfones, polyarylates and the like. While these face shield materials are usable in relatively high temperature environments of the type often encountered by fire fighters, they sometimes begin to melt under high temperature conditions such that the plastic material begins to deform, as by sagging or drooping.

During the initial stages of fire fighting activity, the wearer of such a helmet will often be clothed in high temperature protective apparel including, of course, a suitable protective face mask. Under those conditions, the plastic face shield is not used and is disposed in a raised storage position wherein a front portion of the face shield overlies the top of the helmet. Only after the initially intense flames are brought under manageable control and the situation becomes reasonably stabilized, does the chopping away of charred and smoldering timber, and the like usually begin wherein axes are used. When this latter is activity is about to commence, the fire fighter will tilt this face shield downwardly from its stored position into a face shielding position so as to protect his face against projectiles such as wood splinters, glass and so forth which are likely to be encountered when using an ax.

But during the initial stages of fire fighting activity where the heat encountered is likely to be at its most intense, the shield will normally be in the raised storage position and it is this stage with which my invention is principally concerned. Under such circumstances, prior art face shields in the stored position sometimes begin to sag and droop in the region of the diagonally extending lower margins of the end sections. Occasionally, such deformities are so severe that the plastic material of the end sections actually sags below the rim of the helmet where it can come into contact with the fire fighters face, neck and/or shoulders or into contact with his protective apparel. In either case, a serious burn, damage to his protective apparel or both, can occur.

Recently, the National Fire Protection Association has developed new standards for such plastic face shields which require these devices to withstand a temperature of 500° for a five minute period without deforming to the extent of sagging or drooping below the brim of the helmet when in the stored position. The plastics commonly in use in face shields at this time, such as those previously mentioned, cannot, by themselves, meet such a standard.

By means of my invention, this difficulty is now overcome.

SUMMARY OF THE INVENTION

It is therefore an object of my invention to provide means for preventing end sections of a plastic face shield which are pivotally attached to a hard hat from deforming and sagging below a brim of the hard hat when the face shield is subjected to high temperatures in the range of about 500° F. for up to 5 minutes in duration.

It is a further object of my invention to provide a face shield assembly for a fire fighter's helmet which includes end sections which are protected from severe deformation in high temperature environments such as encountered in burning buildings.

It is another object of my invention to provide a face shield assembly for a hard hat which includes end sections adapted to reflect heat outwardly away from the hard hat.

Briefly, in accordance with my invention, a face shield assembly for use with a hard hat, such as a fire fighter's helmet, is provided. The assembly includes a transparent plastic face shield having a pair of spaced apart, parallel extending end sections adapted for pivotal attachment to opposite sides of a hard hat such that the face shield can be manually tilted between a raised storage position over the hard hat and a lowered face shielding position below the front of the hard hat. Means is attached to each of the end sections for reflecting heat therefrom and for preventing plastic material in the end sections from deforming and sagging about the face, neck and shoulders of a wearer of the hard hat when the face shield is disposed in a raised storage position over the hard hat and when exposed to a high temperature environment.

These and other objects, features and advantages of my invention will become apparent to those skilled in the art from the following detailed description and attached drawings upon which, by way of example, only a preferred embodiment of my invention is illustrated.

DESCRIPTION OF THE PREFERRED EMBODIMENT

Figure 1:
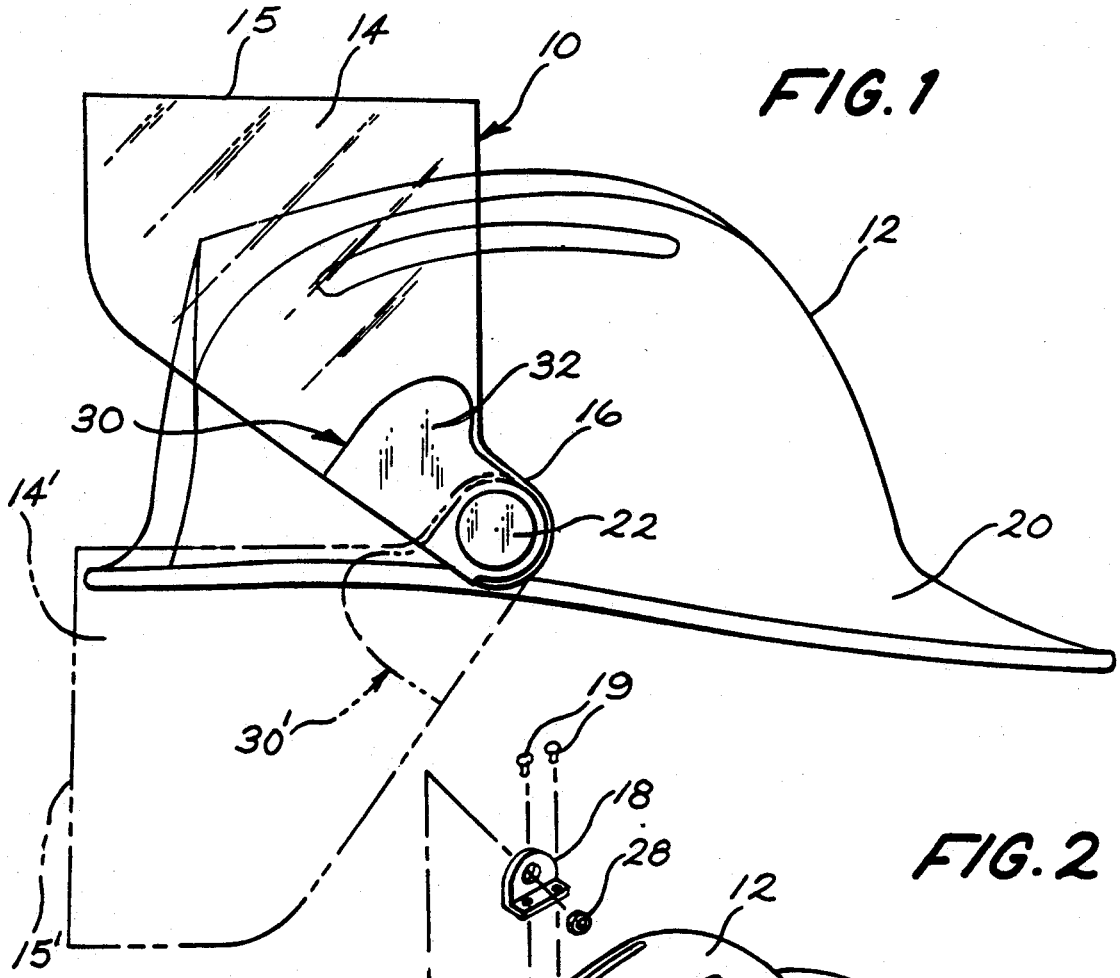
FIG. 1 shows a side elevation view of a fire fighter's helmet and face shield assembly, thus illustrating a preferred embodiment of my invention.
Figure 2:
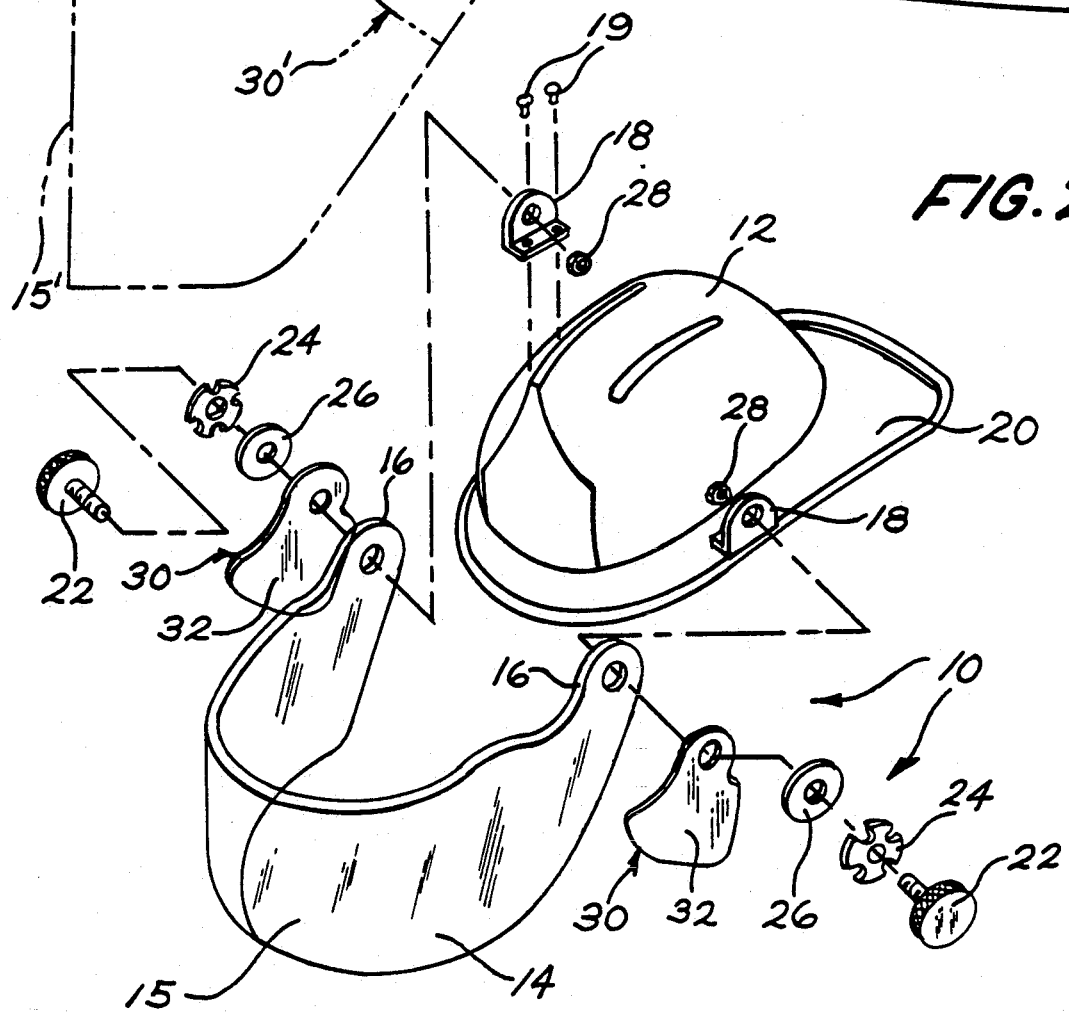
FIG. 2 shows an exploded perspective view of the fire fighter's helmet and face shield assembly of FIG. 1.
Figure 3:
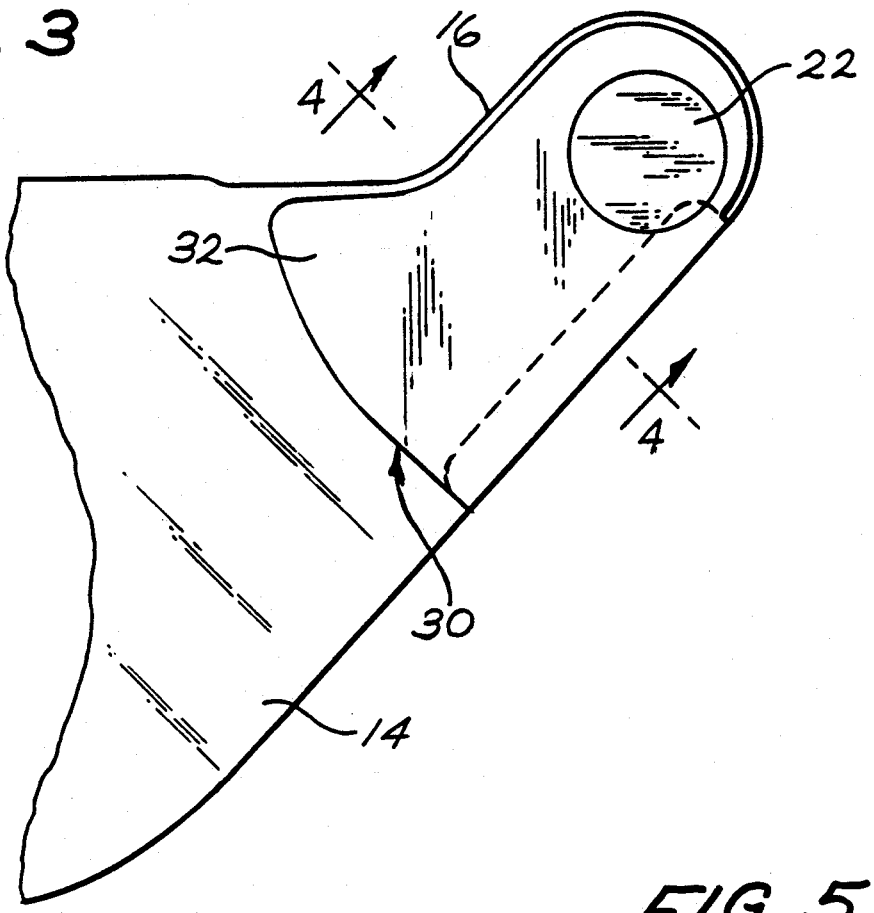
FIG. 3 shows a side elevation view of a portion of the face shield assembly of FIG. 1, such portion being one of two end sections thereof.

Referring now to the drawing figures there is shown, in a preferred embodiment of my invention, a novel face shield assembly, generally designated 10, for use on a hard hat, such as a conventional fire fighter's helmet 12. The assembly 10 includes a conventional transparent high temperature plastic face shield 14, 14' which includes a frontal face shielding portion 15 that narrows as it extends rearwardly to a pair of end sections 16 which are pivotally attached to angle brackets 18. The angle brackets 18 are secured to a brim 20 of the helmet 12 on opposite sides thereof in any suitable, well know manner such as by means of screws 19. Pairs of conventional knob screws 22, spring washers 24, flat washers 26 and lock nuts 28 are used to pivotally attach the end sections 16 to their corresponding angle brackets 18, all in a conventional and well known manner. Accordingly, the wearer of the helmet 12 can readily tilt the face shield 14, 14' as shown in FIG. 1 to a raised storage position, shown in full at 14, wherein the frontal portion 15 overlies the top of the helmet 12 when not in use. Similarly, the wearer can readily tilt the face shield downwardly from the storage position 14 to an operative face shielding position, shown in FIG. 1 in phantom at 14', when necessary.

Figure 5:
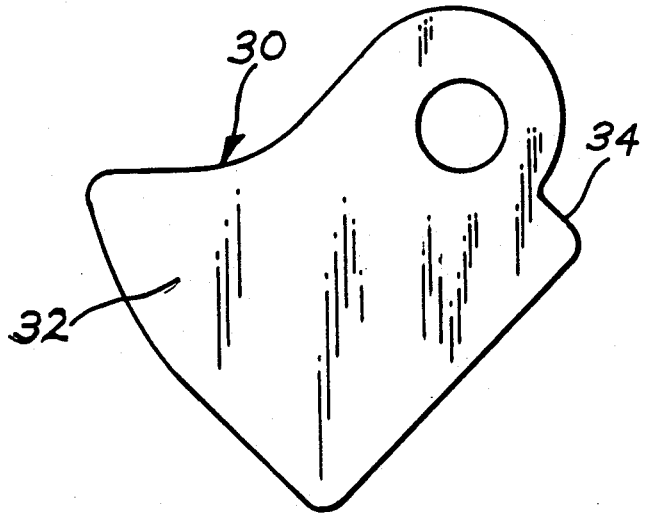
FIG. 5 shows a side elevation view of a novel appliqué for use on a fire helmet face shield, the same being a component of the face shield assembly of FIGS. 1–4.

A pair of novel appliqués 30, which may be constructed of highly thermally reflective aluminum alloy sheet or aluminum foil or other metallic sheet or foil, is provided, each of which has a broad surface 32 (FIG. 4) which essentially covers a broad outwardly facing surface of each of the end sections 16 of the face shield 14. By use of the term, aluminum, as used herein, I mean aluminum in its pure form as well as commonly known alloys thereof. A base portion 34 (See FIG. 5) of each of the appliqués 30 forms a channel 35 (See FIG. 4) in which a lower edge of each of the end sections 16 is disposed. The appliqués 30 are preferably affixed to the plastic surfaces of their corresponding end sections 16 by means of a suitable high temperature adhesive such as, for example, a conventional high temperature acrylic adhesive.

Figure 4:
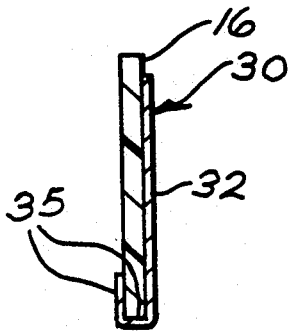
FIG. 4 shows a cross-sectional elevation view of the face shield assembly of FIGS. 1–3 as viewed along cross-section lines 4—4 of FIG. 3.

In the alternative, the appliqués 30 may be constructed of 0.010 to 0.020 inch thick heat reflective, preferably shiny aluminum alloy sheet which should be patterned to essentially cover the broad outer facing surface of each of the end sections 16 and so as to have an excess portion 34 along the base thereof which can be crimped to form the channel 35 in and along which a lower edge portion of a corresponding one of the end sections 16 can be disposed in tight fitting relation as illustrated most clearly in FIG. 4. I also believe that other types of metal such as brass may be used to construct the appliqués 30, although I have not tested appliqués constructed of anything other than aluminum at the present time.

When the face shield 14 with the appliqués 30 attached thereto is in its raised storage position on the helmet 12 and is exposed to a temperature of 500° F. for a period of 5 minutes, in accordance with the National Fire Protection Associations most recently established "Standards on Helmets for Structural Fire Fighting", the appliqués 30 prevent the plastic material of the end sections 16 from deforming in such way as to sag or droop below the sides of the brim 20 to possibly come into contact with the face, neck or shoulders of the wearer of the helmet 12 to thus cause a serious burn to the wearer, damage to his wearing apparel or both. It is important that the appliqués 30 be as highly reflective of light and, consequently, heat, as possible to delay the tendency of the plastic of the face shield 14 to thermally deform under exposure to a high temperature environment for as long a time period as possible. It is also important that the appliqués 30 form the channels 35 so as to restrain the lower edge portions of the end sections 16 from sagging or otherwise deforming under exposure to temperatures near 500° F. for up to 5 minutes, particularly when the face shield 14 is in its raised storage position, as at 14 in FIG. 1, which would most likely be the case when the wearer encounters such temperatures.

Although the present invention has been explained with respect to specific details of a certain preferred embodiment thereof, it is not intended that such details limit the scope of the invention other than as specifically set forth in the following claims.

I claim:

1. A face shield assembly for use with a hard hat, such as a fire fighter's helmet, comprising a transparent plastic face shield including a pair of spaced apart, parallel extending end sections adapted for pivotal attachment to opposite sides of a hard hat such that said face shield can be manually tilted between a raised storage position over said hard hat and a lowered face shielding position below a front of said hard hat, and means attached to each of said end sections for reflecting heat therefrom and for preventing plastic material in said end sections from deforming and sagging about the face, neck and shoulders of a wearer of said hard hat when said face shield is disposed in a raised storage position over said hard hat and when exposed to a high temperature environment, each of said means essentially covering an outer facing broad surface of a different one of said end sections and forming a channel confining a lower edge portion of its corresponding end section therein in close fitting relation.

2. The assembly of claim 1 wherein said reflecting and preventing means comprises a metallic appliqué.

3. The assembly of claim 2 wherein each said appliqué is attached to and essentially covers an outwardly facing broad surface of a different one of said end sections to reflect heat away from said end sections and helmet, each said appliqué also extending across an underside edge of a corresponding one of said end sections and upwardly along a medially facing surface of a corresponding one of said end sections to form a close fitting channel in which an underside edge portion of a corresponding one of said end sections is disposed.

4. The assembly of claim 2 wherein said appliqué is between about 3 and 5 mils in thickness.

5. The assembly of claim 3 wherein said appliqué is adhesively attached to said end sections.

6. The assembly of claim 5 wherein said appliqué is adhesively attached to each said end sections by means of a high temperature acrylic adhesive.

7. The assembly of claim 2 wherein said appliqué comprises aluminum foil.

8. The assembly of claim 2 wherein said appliqué comprises aluminum alloy sheet.

9. The assembly of claim 1 wherein said reflecting and preventing means comprises a pair of metal sheets.

10. The assembly of claim 9 wherein said sheets are between 10 and 20 mils in thickness.

11. The assembly of claim 9 wherein said metal sheets comprise aluminum alloy.

* * * * *